US012529299B2

(12) United States Patent
Pfutzner et al.

(10) Patent No.: US 12,529,299 B2
(45) Date of Patent: Jan. 20, 2026

(54) ENHANCING TRANSVERSE FRACTURES WHILE PERFORMING HYDRAULIC FRACTURING WITHIN AN OPENHOLE BOREHOLE

(71) Applicant: SCHLUMBERGER TECHNOLOGY CORPORATION, Sugar Land, TX (US)

(72) Inventors: Harold Pfutzner, Richmond, TX (US); Gallyam Aidagulov, Dhahran (SA); Mohammed Badri, Al-Khobar (SA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 637 days.

(21) Appl. No.: 17/254,367

(22) PCT Filed: Jun. 19, 2019

(86) PCT No.: PCT/US2019/038002
§ 371 (c)(1),
(2) Date: Dec. 21, 2020

(87) PCT Pub. No.: WO2019/246272
PCT Pub. Date: Dec. 26, 2019

(65) Prior Publication Data

US 2021/0270115 A1 Sep. 2, 2021

Related U.S. Application Data

(60) Provisional application No. 62/688,881, filed on Jun. 22, 2018.

(51) Int. Cl.

| | |
|---|---|
| ***E21B 43/263*** | (2006.01) |
| ***E21B 43/116*** | (2006.01) |
| ***E21B 43/117*** | (2006.01) |

(52) U.S. Cl.
CPC ..... *E21B 43/263* (2013.01); *E21B 43/116* (2013.01); *E21B 43/117* (2013.01)

(58) Field of Classification Search
CPC .... E21B 43/116; E21B 43/117; E21B 43/119; E21B 43/263; E21B 43/11
See application file for complete search history.

(56) References Cited

U.S. PATENT DOCUMENTS 2,587,244 A * 2/1952 Sweetman ..... E21B 29/02 175/4.6
4,467,878 A * 8/1984 Ibsen ..... E21B 43/117 175/4.6

(Continued)

FOREIGN PATENT DOCUMENTS

WO 2016115204 A1 7/2016

OTHER PUBLICATIONS

Aidagulov, G. et al., "Model of Hydraulic Fracture Initiation from the Notched Open Hole", SPE 178027-MS, presented at the SPE Saudi Arabia Section Annual Technical Symposium and Exhibition, Al-Khobar, Saudi Arabia, 2015, 13 pages.

(Continued)

*Primary Examiner* — Yong-Suk (Philip) Ro
(74) *Attorney, Agent, or Firm* — Jeffrey D. Frantz

(57) ABSTRACT

A downhole tool includes a metal carrier tool body having at least one cavity formed in and opening to an outer surface, defining an outer diameter of the metal carrier tool body. The downhole tool includes one or more explosive notching elements mounted in the at least one cavity. One or more explosive notching elements are configured to install notches on a surface of an uncased formation.

20 Claims, 9 Drawing Sheets

(56) References Cited

U.S. PATENT DOCUMENTS

| | | | | |
|---|---|---|---|---|
| 5,505,134 | A * | 4/1996 | Brooks | F42D 1/045 102/202.7 |
| 2005/0167108 | A1 | 8/2005 | Chang et al. | |
| 2010/0000789 | A1* | 1/2010 | Barton | E21B 43/11852 175/2 |
| 2014/0314614 | A1 | 10/2014 | Glenn | |
| 2014/0373743 | A1 | 12/2014 | Mace et al. | |
| 2017/0037712 | A1 | 2/2017 | Davidson | |
| 2017/0058649 | A1* | 3/2017 | Geerts | C06C 5/04 |
| 2017/0254186 | A1 | 9/2017 | Aidagulov et al. | |

OTHER PUBLICATIONS

Bartko, K. et al., "First Application for a Sequenced Fracturing Technique to Divert Fractures in a Vertical Open Hole Completion: Case Study from Saudi Arabia", SPE-179127-MS, Presented at the SPE Hydraulic Fracturing Technology Conference, Woodlands, Texas, USA, 2016, 15 pages.

"PowerCutter Precision Tubular Cutter", Schlumberger Brochure, Document 11-PR-0009, 2011, 4 pages.

International Search Report and Written Opinion of International Patent Application No. PCT/US2019/038002 dated Oct. 16, 2019, 12 pages.

International Preliminary Report on Patentability of International Patent Application No. PCT/US2019/038002, dated Dec. 20, 2020, 9 pages.

"Pipe Recovery Products", Jet Research Center brochure, Document H012695, Jul. 2018, pp. 1-9.

* cited by examiner

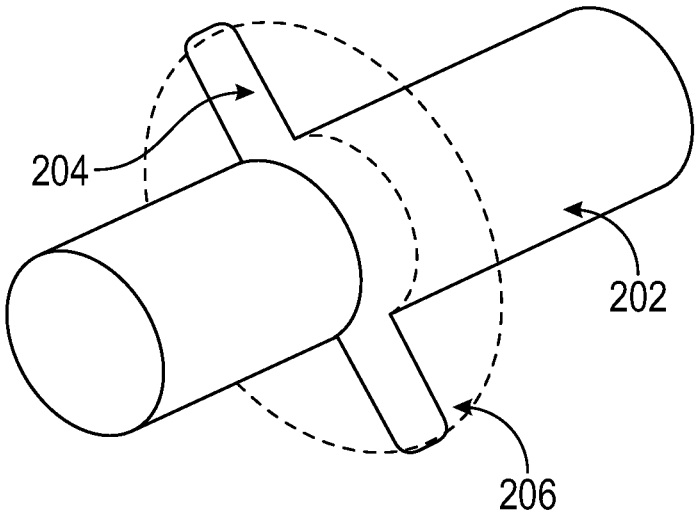
FIG. 2.1
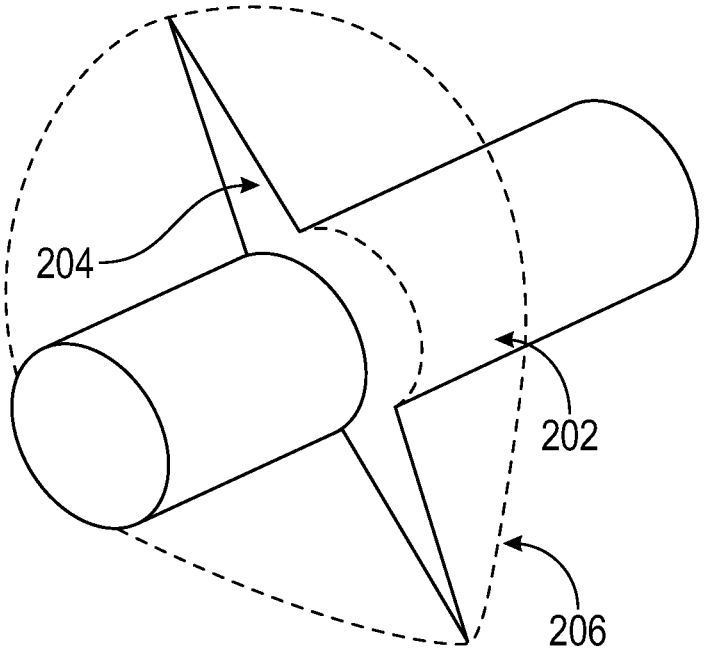
FIG. 2.2

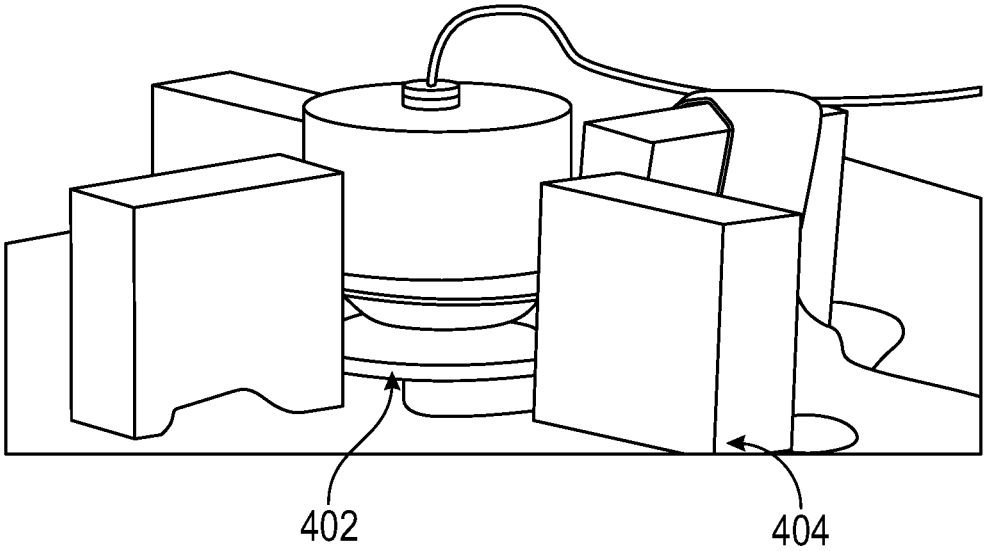
FIG. 4.1
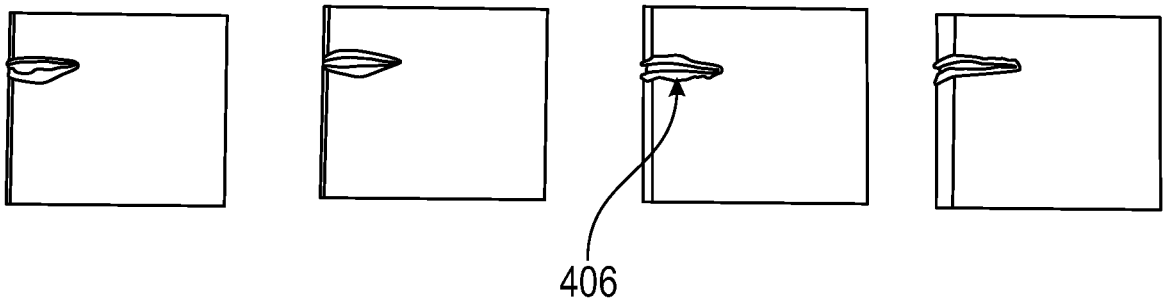
FIG. 4.2

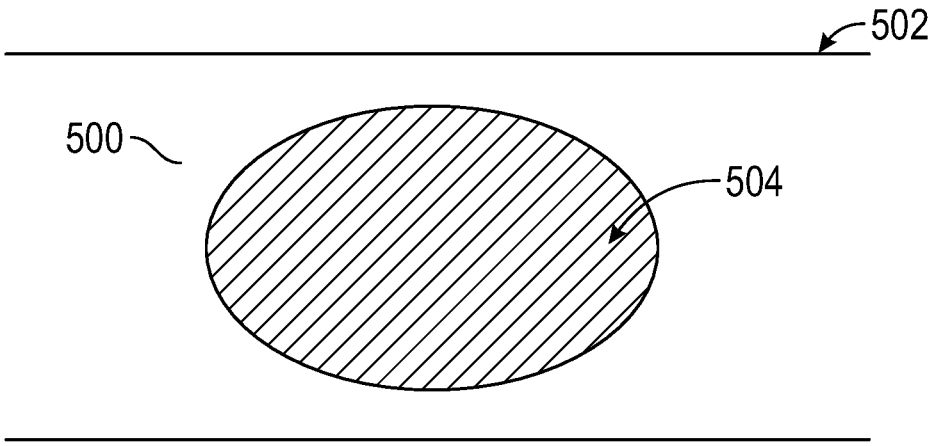
FIG. 5.1
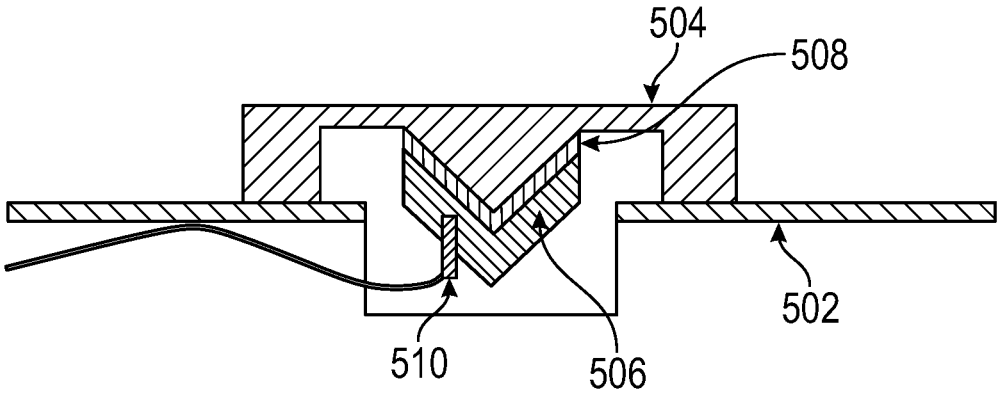
FIG. 5.2

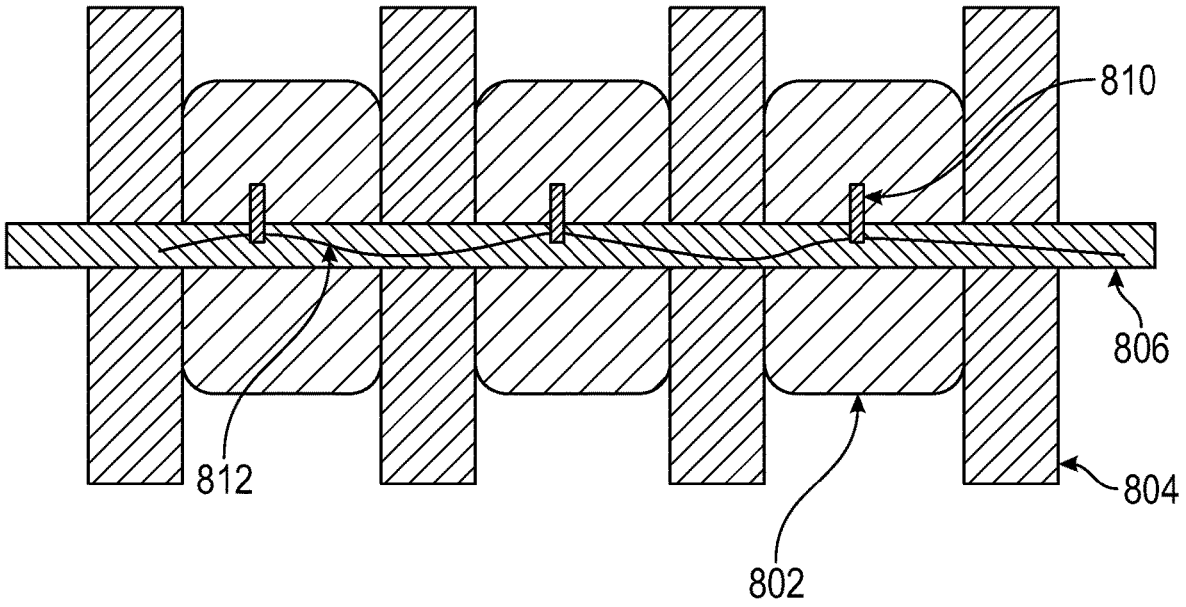
FIG. 8.1
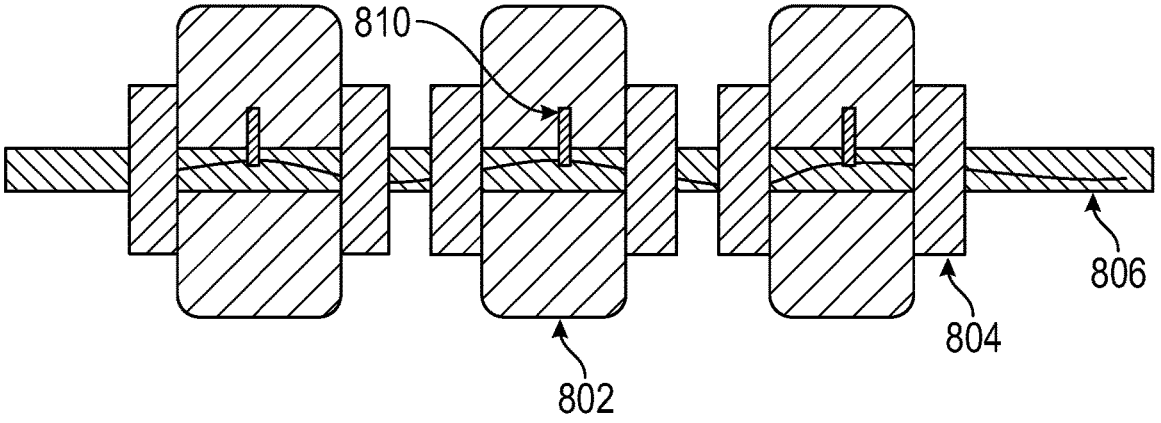
FIG. 8.2

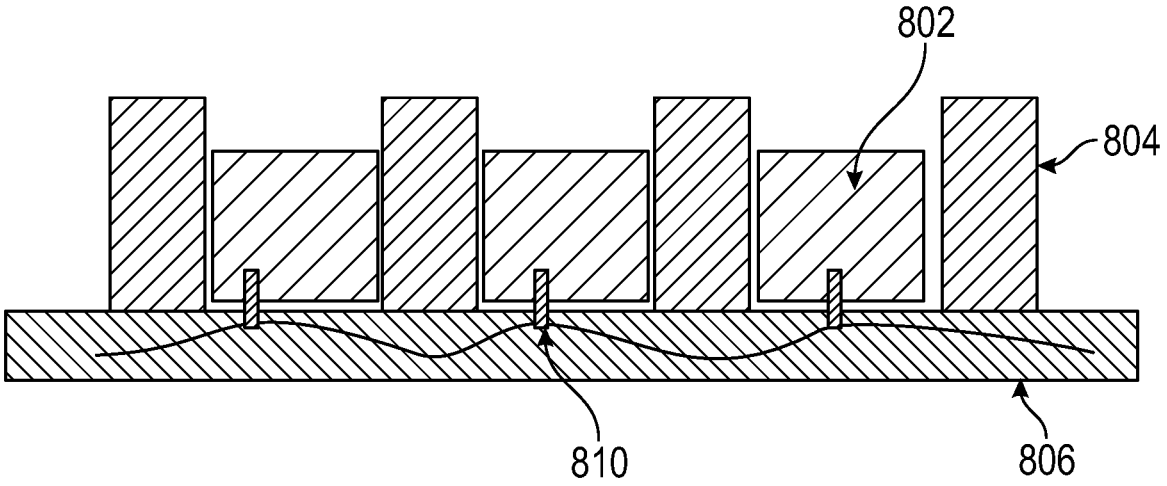
FIG. 8.3

ENHANCING TRANSVERSE FRACTURES WHILE PERFORMING HYDRAULIC FRACTURING WITHIN AN OPENHOLE BOREHOLE

CROSS-REFERENCE TO RELATED APPLICATION

This application is a national stage entry under 35 U.S.C. § 371 of International Application No. PCT/US2019/038002, filed on Jun. 19, 2019, which claims the benefit of U.S. Provisional Application No. 62/688,881, filed on Jun. 22, 2018, the contents of which are incorporated herein by reference.

BACKGROUND

During the past decade, the depletion of conventional reservoirs has led to the exploration and production of unconventional hydrocarbon fuels. Shale, a highly abundant sedimentary rock, has been identified as a reliable and secure new source of hydrocarbons. Shale formations are associated with very low permeability, which often require hydraulic fracturing to improve the flow of oil and gas to the well. In addition, tight formations such as those formed from sandstone or carbonate may be functionally similar to shale, and benefit from stimulation by hydraulic fracturing. In particular, both types of unconventional resources are accessed with horizontal wells and other standard techniques associated with hydraulic fracturing.

Technological advances in fracturing unconventional deposits from shales and other tight formations may play a key role in time- and cost-efficient hydrocarbon production. While significant leaps forward in technology can have an impact on production cost, incremental improvements in methods, materials, and procedures have a multiplicative effect due to the sheer volume of fracking stages, wells, drilling rigs, manpower, and materials used in a single reservoir, single basin, or single country.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In an embodiment, a downhole tool includes a metal carrier tool body having at least one cavity formed in and opening to an outer surface defining an outer diameter of the metal carrier tool body and one or more explosive notching elements mounted in the at least one cavity, wherein the one or more explosive notching elements are configured to install notches on a surface of an uncased formation.

In an embodiment, a method includes emplacing an explosive notching tool into an uncased zone in the formation, wherein the explosive notching tool includes a metal carrier tool body having at least one cavity formed in and opening to an outer surface defining an outer diameter of the metal carrier tool body, and one or more explosive notching elements mounted in the at least one cavity; detonating one or more explosive notching elements on the explosive notching tool; and generating one or more circular notches in the uncased zone in the formation.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings.

FIGS. 2.1 and 2.2 show examples of formation notching performed according to embodiments of the present disclosure;

FIGS. 4.1 and 4.2 are illustrations depicting the 360-degree blast radius for an explosive notching tool in accordance with embodiments of the present disclosure;

FIGS. 5.1 and 5.2 are illustrations depicting the design of a directionalized explosive formation notching tool in accordance with embodiments of the present disclosure;

FIGS. 8.1-8.3 are a number of possible design configurations for explosive notching tools in accordance with embodiments of the present disclosure.

DETAILED DESCRIPTION

Figure 1:
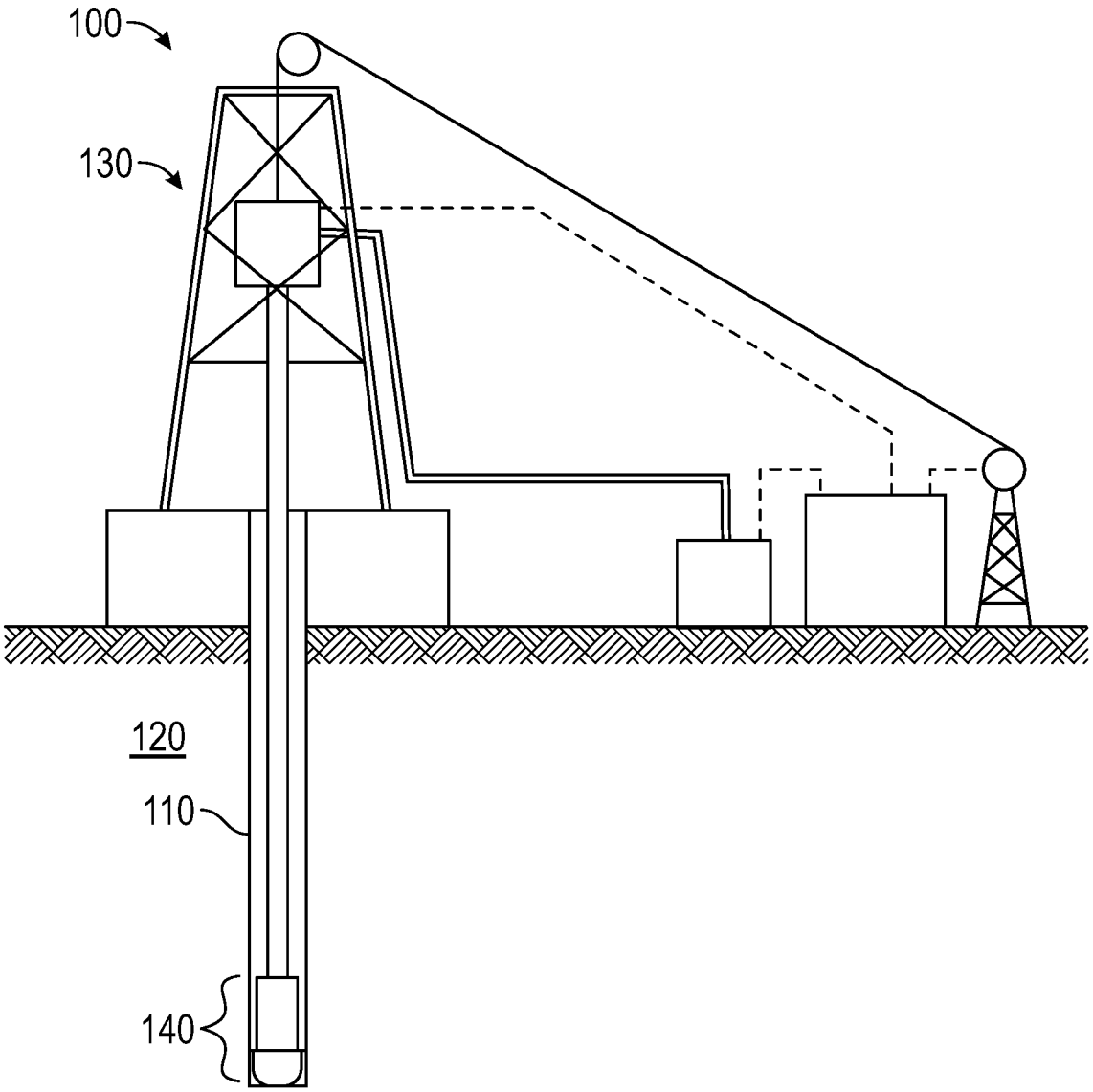
FIG. 1 shows an example of a drilling system according to embodiments of the present disclosure.

The particulars shown herein are by way of example and for purposes of illustrative discussion of the examples of the subject disclosure only and are presented in the cause of providing what is believed to be the most useful and readily understood description of the principles and conceptual aspects of the subject disclosure. In this regard, no attempt is made to show structural details in more detail than is necessary, the description taken with the drawings making apparent to those skilled in the art how the several forms of the subject disclosure may be embodied in practice. Furthermore, like reference numbers and designations in the various drawings indicate like elements.

In one aspect, embodiments disclosed herein relate generally to explosive notching tools for use in wellbore stimulation operations to control the placement and formation of induced fractures. The particulars shown herein are by way of example and for purposes of illustrative discussion of the examples of the subject disclosure only and are presented in the cause of providing what is believed to be the most useful and readily understood description of the principles and conceptual aspects of the subject disclosure. In this regard, no attempt is made to show structural details in more detail than is necessary, the description taken with the drawings making apparent to those skilled in the art how the several forms of the subject disclosure may be embodied in practice. Furthermore, like reference numbers and designations in the various drawings indicate like elements.

Embodiments of the present disclosure are directed to methods and tools for use in hydraulic fracturing and enhanced recovery from uncased wellbores in unconventional and/or tight formations. Because of the very low permeability that tight formations share with shale formations, many of the technologies applied to shale oil and gas extraction may be extended to tight formations in some instances. In particular, unconventional resources may be stimulated through hydraulic fracturing and/or horizontal drilling. However, tight formations such as carbonate and sandstone may be competent and resist cave in and flow into the borehole during drilling and fracturing. In tight formations, it is often possible to complete a well without casing in the horizontal section that penetrates the reservoir rock. This openhole completion is also known as a barefoot completion. An openhole completion, when possible, represents a significant cost savings in time and materials when compared to cased hole completion.

While openhole completions in tight formations offer time and cost savings, they also present some different challenges for the process of hydraulic fracturing. Hydraulic fracturing in a cased hole often involves perforating the casing in the horizontal section of the well. The perforations are placed where log data indicates a favorable prospect of oil or gas production. During the hydraulic fracturing process, the fractures will occur where the perforations are located. Perforations are grouped in clusters along the borehole and the locations of the clusters have been chosen such that the formation surrounding a cluster of perforations has approximately uniform rock properties.

An important aspect of hydraulic fracturing is the procedure of dividing the length of the borehole into many stages (typically between 10 and 25), such that each stage is hydraulically isolated from the others and the stages are independently fractured one at a time. This procedure is necessary to get many fractures distributed along the borehole. Attempting to fracture all locations at once will result in a single set of very large fractures at the position of the weakest rock, which leaves most of the hydrocarbon potential of the well not accessed.

In the case of an openhole completion in a tight sandstone or carbonate formation, the method described above for isolating hydraulic stages for fracturing is not possible, because no casing is present. Instead, openhole packers are installed at the boundary of each stage. Openhole packers are cylindrical, expandable elements that can be deformed easily to contact the uneven formation surface, yet retain strength and sufficient integrity to withstand the anticipated differential pressures. Openhole packers may also have a central channel for accommodating the passage of well mechanical services equipment.

Another difference between hydraulic fracturing in openhole and cased hole completion is the absence of perforations. In openhole, fracturing notches are made in the formation at locations identified as zones of interest by various well logs, which would have been perforated in the case of a cased hole completion. Notches installed on borehole surfaces in an uncased well enhance the probability that fractures will occur at notch sites during hydraulic fracturing and that induced fractures will form transversely to the borehole rather than longitudinally.

Notches can be generated in an uncased formation at favorable locations identified by well logs, in a manner analogous to the selection of locations for perforating during cased hole completion. The notches enhance the probability that fractures will occur during hydraulic fracturing at those positions and will occur transversely to the borehole rather than longitudinally. Notches in an openhole formation may be made with a cutting device such as a rotating water jet or abrasi-jet (slurry of water and abrasive material), which produce notches that are about 1 inch wide and have a depth approximately equal to the borehole diameter.

In one or more embodiments, methods and tools in accordance with the present disclosure use controlled explosions to generate notches in an openhole formation for the purpose of controlling fractures during hydraulic fracturing. In one aspect, notching methods for uncased formations may reduce the time required to create notches, simplify the operations procedure, and increase the notch effectiveness by creating deep notches, with narrow width, and an acute angle at the tip of the notch. Notching methods in accordance with the present disclosure may also reduce the time required for the total operation and can potentially improve the productivity of a well, following subsequent fracturing operations.

In one or more embodiments, explosive notching tools may be used to place notches in a borehole prior to hydraulic fracturing in tight (low permeability) formations such as sandstone carbonate with an openhole completion. The placement of notches in a formation may be used to predetermine the location of hydraulic fractures and control the development of fractures to some degree. For example, notching can bias fracture formation such that induced fractures are transverse to the borehole and extend into the formation to enhance hydrocarbon recovery, as opposed to the formation of longitudinal fractures that form shallow channels in the near-wellbore region. Notching can also reduce the overall hydraulic pressure required to initiate fracturing, decreasing pumping energy required and avoiding uncontrolled fracturing in more permeable regions within a wellbore.

In one or more embodiments, explosive notching tools may be used to create circular notches through the detonation of an explosive charge that is directed radially from a borehole center and covers all angles azimuthally. Explosive notching tools in accordance with the present disclosure may improve operational efficiency and enhance recovery. Previous techniques used to generate notches in uncased formations such as water jet or abrasi-jet may take up to 40 minutes or longer to generate a single notch within an interval of the formation. However, explosive notching tools may use circular charges that generate notches within an uncased formation instantaneously, and without the need to transport water or slurry with abrasives from the surface to the notch position. Rather, a supply of electronic current to trigger the detonation is used to detonate the explosive notching element.

Explosive notching tools in accordance with the present disclosure may be emplaced within an interval of interest using several methods such as wireline, coiled tubing, and the like. With particular respect to FIG. 1, a simplified example system for lowering an explosive notching tool into a wellbore is shown. In this example, a wireline system 100 is used to lower an explosive notching tool 140 into a well 110 traversing a formation 120. Control equipment 130 is located at the surface of the formation 120 and extends into the well 110. While a wireline system is shown in this example, any suitable delivery mechanism may be used, including coiled tubing, tubulars, drill string, as a component on a completion string or fracturing sub, and the like.

Methods in accordance with the present disclosure may be used to generate notches in a formation having greater depth than height and an acute angle at the tip of the generated notch. With respect to FIGS. 2.1 and 2.2, schematics of notches created by various methods are shown. FIG. 2.1 shows a wellbore 202 having a notch 204 generated by water jet or abrasi-jet extending into the wellbore that may be approximated by a diameter defined by 206. FIG. 2.2 shows a wellbore 202 having a notch 204 generated by explosive charge extending into the wellbore that may be approximated by a diameter defined by 206. Comparing the two types of notches, the notch created by explosive charge is narrower, has a more acute angle at its tip, and extends further into the formation when compared to the jet-induced notch. These features may enhance the probability that a hydraulic fracture will occur at the notch location and that the fracture will be transverse to the borehole. In addition, notching the formation reduces the hydraulic pressure required for subsequent fracturing operations.

Explosive formation notching tools in accordance with the present disclosure may create circular notches into a hydrocarbon bearing competent formation within an uncased, or openhole borehole. Explosive notching tools in accordance with the present disclosure may be based on explosive pipe cutter tool designs used to cut heavy pipes within boreholes.

In one or more embodiments, explosive notching tools generally may include a metal carrier tool body having at least one cavity formed in and opening to an outer surface defining an outer diameter of the metal carrier tool body, and one or more explosive notching elements mounted in the at least one cavity. Explosive notching elements may be directional or may direct explosive forces radially from the tool center. Radially-directed explosive notching elements may form "circular" notches, where a circumferential notch is formed and extends along the entire inner circumference of the borehole or the full azimuth (360°), or substantially the full azimuth, of the azimuthal angles from the borehole center to the tip of the formed notch.

In one or more embodiments, explosive notching tools may include a metal carrier frame, radial explosive charges, and logging equipment head that can be mechanically attached to a coiled tubing conveyance system having a wireline logging cable. In some embodiments, explosive notching tools may include a metal carrier frame, radial explosive charges, logging equipment head and coiled tubing conveyance system that is combinable with other coiled tubing conveyed devices used during hydraulic fracturing.

In one or more embodiments, explosive notching tools in accordance with the present disclosure may include a logging equipment head with electrical feedthroughs that can be attached to a wireline logging cable or other wiring to communicate directly or wirelessly with an operator at the surface or at a remote location. Logging equipment may include any suitable well logging devices including resistivity, nuclear magnetic resonance, neutron, and the like.

In one or more embodiments, explosive formation notching tools of the present disclosure may use an electric current to trigger detonation. In some embodiments, one or more explosive notching elements are electronically wired for control from outside of a wellbore by a wiring connection. For explosive notching tools having multiple explosive notching elements, the explosive notching elements may be controllable for detonation individually, detonation in rapid succession, or in stages at varied time intervals.

Figure 3:
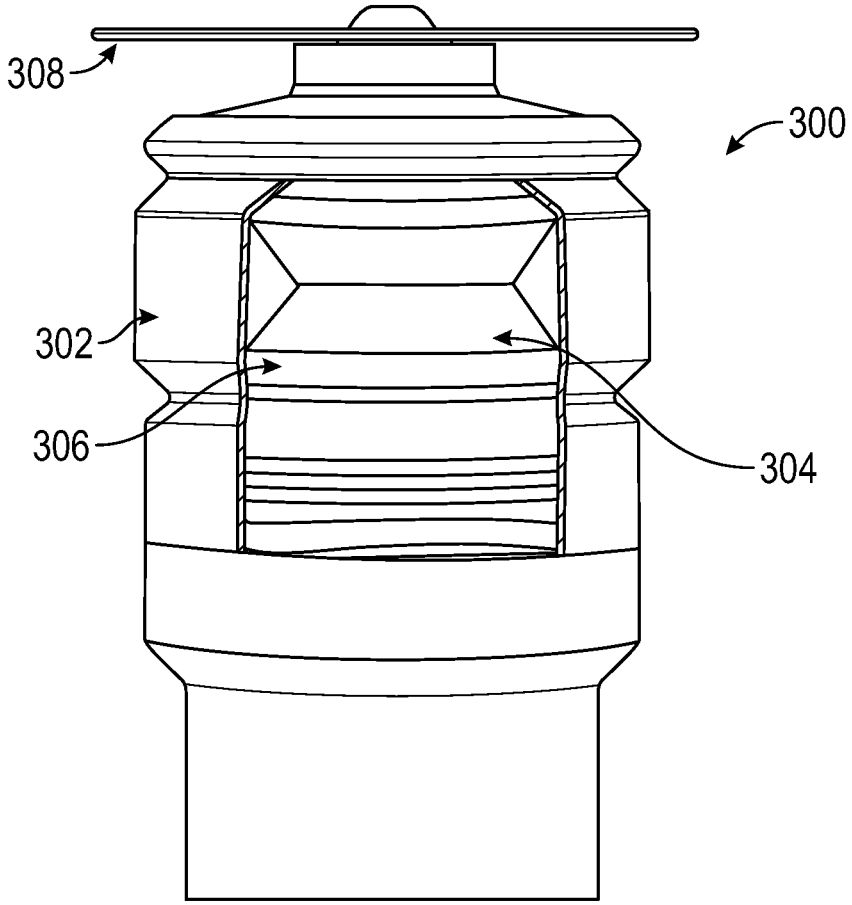
FIG. 3 is an example of an explosive formation notching tool in accordance with embodiments of the present disclosure.

With particular respect to FIG. 3, an example of an explosive notching element 300 is shown with a cutaway 304 through the outer protective housing 302. A shaped projectile 306 is shown, which overlays an axially-directed explosive material that directs the projectile radially outward into the formation from the explosive notching element 300. Explosive notching element 300 may be wired by electrical wiring 308, which ignites the detonator and the explosive material following an electrical trigger.

With particular respect to FIG. 4.1, an experimental setup for demonstrating the formation of a circular fracture is shown. In the example, an explosive notching element 402 is arranged within an enclosure created by 4 steel plates 404. With particular respect to FIG. 4.2, the metal plates 404 are shown after the detonation of the explosive notching element 402. Notch 406 is visible on all 4 metal plates 404.

FIGS. 5.1-5.2 show the basic geometry and constituents of a directional explosive notching element in accordance with embodiments of the present disclosure. With respect to FIG. 5.1, a portion of an explosive formation notching tool is shown in which a metal carrier frame 502 is equipped with an explosive notching element 500 having an outer housing 504. One or more explosive notching elements 500 may be mounted on a metal carrier frame 502 with various spacings and azimuthal orientation, in order to create a desired pattern of perforations within the casing that is within a borehole. With particular respect to FIG. 5.2, a cross section of the explosive notching element is shown as installed in the metal carrier frame 502. Within outer housing 504, the explosive charge 506 is shown underlain a projectile 508. When the explosive notching tool is emplaced within a target zone, explosive charge 506 is ignited by electric current supplied to detonator 510. In some embodiments, wiring for detonator 510 may be contained within carrier frame 502, which may protect the wiring during emplacement downhole.

Figure 6:
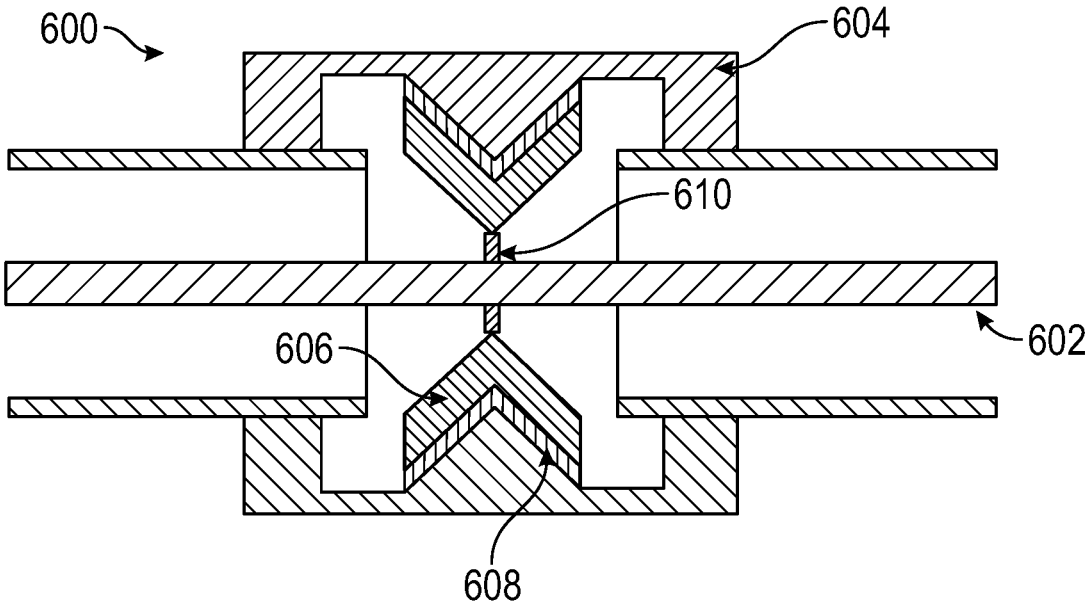
FIG. 6 is an illustration depicting the design of a radially-directed explosive formation notching tool in accordance with embodiments of the present disclosure.
Figure 7:
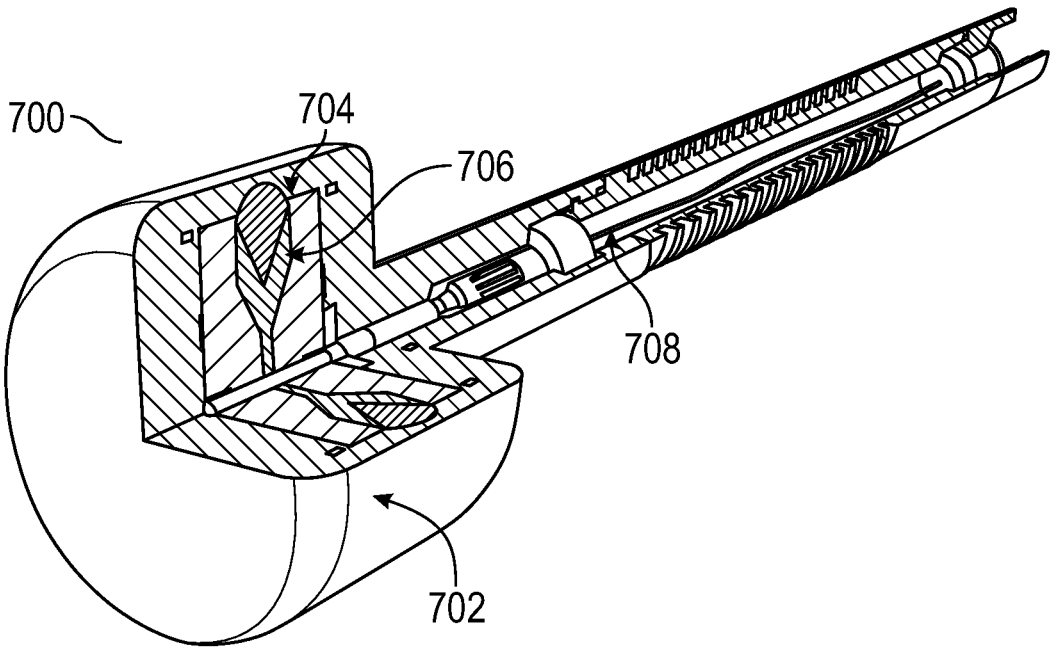
FIG. 7 is an illustration depicting a partial cross-section of an explosive notching tool in accordance with embodiments of the present disclosure.

In one or more embodiments, the conical shaped charge of the perforating gun can be extended circularly around the center of the gun, which ejects a projectile radially into an openhole formation and covering the full circumference or azimuth (360°). With respect to FIG. 6, a portion of an explosive notching tool is shown in which a radially configured explosive notching element 600 is arranged about a hollow support tube 602 and protected by outer housing 604. The explosive charge 606 is underlain below projectile 608. When the explosive notching tool 600 is emplaced within a target zone, explosive charge 606 is ignited by electric current supplied to detonator 610. Wiring for the detonator 610 may be wired by connections that pass within the hollow tube 602 in some embodiments An example of an explosive notching tool 700 in accordance with the present disclosure is shown in FIG. 7. In the figure, cross-section of outer housing 702 shows the arrangement and design of the projectile 704, which overlays explosive material 706. The tool design also incorporates a hollow mandrel 708, through which electronic wiring may be routed. In addition, the tool may incorporate sensors and various logging tools to enhance positioning and to verify the fracture formation following detonation of the device.

In one or more embodiments, explosive notching tools in accordance with the present disclosure may include a frame and/or rod construction that enables multiple explosive charges to be lowered into the borehole simultaneously. Explosive notching tools may have various spacings between charges. Explosive notching tools incorporating multiple explosive elements may be wired such that the explosive elements are individually addressable and may be fired simultaneously, or sequentially, or a combination of the two (such as when a subset is detonated simultaneously while a second subset is detonated at a later time point). In one or more embodiments, charges may be detonated in order by depth. For example, detonation of explosive notching elements may begin from the toe of the well with the charge nearest the bottom of a metal carrier frame, which may be necessary where detonation of a respective explosive notching element can sever the electrical connection within the tool.

Explosive formation notching tools may be designed in a number of configurations. In one or more embodiments, explosive notching tools may be configured with multiple explosive charges. With respect to FIG. 8.1, an embodiment of an explosive notching tool having multiple explosive charges 802 arranged in a metal carrier frame is shown at 804. The metal carrier frame 804 may pass through the center of explosive notching elements 802, to provide support during emplacement and retaining the debris following detonation to enable cleanup and removal. The carrier frame 804 may also be arranged around a hollow mandrel 806, which allows wiring to be delivered and connected to 810 detonators. Electrical wires for detonation pass along the center line of hollow mandrel 806 and may also pass through the center of each explosive notching element 802, which may prevent the electrical wires from being cut during detonation. Metal carrier frame 804 may be constructed such that it survives the force of explosions created by the explosive notching elements, such that the frame remains intact after detonating all charges and can be extracted from the well.

In another embodiment, explosive notching tools may be based on a structure that incorporates a threaded rod that passes through the center opening of one or more explosive notching elements. With respect to FIG. 8.2, explosive notching elements 802 are arranged on a threaded mandrel 806 and held in place by opposing nuts 804 above and below each explosive notching element 802. Threaded center support 806 may be hollow in some embodiments, allowing wiring to be installed within to connect detonators 810 to the explosive notching elements 802.

In another embodiment, explosive notching elements may be directionally oriented on a metal carrier frame. With respect to FIG. 8.3, explosive notching elements 802 are arranged on a metal perforating gun carrier 804. The metal carrier 804 may include a hollow support element 806, which may allow for routing of wiring for explosive element detonators 810 and other connective elements. In some embodiments, the directional design may allow adding or removing of additional explosive notching elements without affecting neighboring explosive elements. Electrical wiring may be routed along a side of one or more explosive notching elements in some embodiments, which results in the electrical connection being severed upon detonation of the explosive. In some embodiments, electrical wiring may be routed through a central passage through the explosive notching element, which may prevent the electrical wiring from being severed upon detonation.

Although only a few examples have been described in detail above, those skilled in the art will readily appreciate that many modifications are possible in the examples without materially departing from this subject disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A downhole tool, comprising:

a metal carrier tool body having at least one cavity formed in and opening to an outer surface defining an outer diameter of the metal carrier tool body; and one or more explosive notching elements mounted in the at least one cavity, wherein each of the one or more explosive notching elements comprises an explosive material extending circumferentially around a center of the at least one cavity and a projectile that overlaps the explosive material circumferentially around the center of the at least one cavity, wherein the one or more explosive notching elements are configured to install notches on a surface of an uncased formation, wherein each of the one or more explosive notching elements are configured to detonate the explosive material, radially expand the projectile, and direct the projectile radially outwardly at all azimuths through 360 degrees to generate one or more circumferential and circular notches in a borehole, wherein the one or more explosive notching elements are disposed proximal to a surface of the borehole.

2. The downhole tool of claim 1, wherein the notches formed by the projectile have a greater depth than height and an acute angle at the tip of the installed notch.

3. The downhole tool of claim 1, wherein the one or more explosive notching elements comprise a plurality of explosive notching elements and are configured to be fired at least one of sequentially and simultaneously.

4. The downhole tool of claim 1, wherein the metal carrier tool body comprises a hollow mandrel that passes through a center of the one or more explosive notching elements, and wherein the hollow mandrel is configured to withstand detonation of the one or more explosive notching elements to enable retrieval from a wellbore.

5. The downhole tool of claim 4, wherein:

the one or more explosive notching elements comprise a plurality of explosive notching elements;

each of the plurality of explosive notching elements includes a detonator; and electrical wiring is disposed through the hollow mandrel and is coupled to each detonator.

6. The downhole tool of claim 1, wherein the one or more explosive notching elements are electronically wired for control from outside of a wellbore by a wiring connection.

7. The downhole tool of claim 6, wherein the wiring connection passes through a center of the one or more explosive notching elements.

8. The downhole tool of claim 1, further comprising:

a logging equipment head with electrical feedthroughs.

9. The downhole tool of claim 8, wherein the downhole tool is configured to be attached to a wireline.

10. The downhole tool of claim 8, wherein the downhole tool is configured to be attached to a coiled tubing.

11. A method, comprising:

emplacing an explosive notching tool into an uncased zone in a formation, wherein the explosive notching tool comprises: a metal carrier tool body having at least one cavity formed in and opening to an outer surface defining an outer diameter of the metal carrier tool body, and one or more explosive notching elements mounted in the at least one cavity and disposed proximal to a surface of the formation, wherein each of the explosive notching elements comprises at least an explosive charge extending circumferentially around a center of the at least one cavity and a projectile that overlaps the explosive charge circumferentially around the center of the at least one cavity; and detonating the explosive charge in the one or more explosive notching elements on the explosive notching tool, wherein detonating radially expands the projectile, and directs the projectile radially outwardly at all angles azimuthally through 360 degrees into the formation and generates one or more circumferential and circular notches in the uncased zone in the formation with the projectile.

12. The method of claim 11, further comprising:

initiating a fracturing operation on the uncased zone in the formation to generate one or more fractures that extend from the one or more circular notches.

13. The method of claim 11, wherein the metal carrier tool body comprises a hollow rod that passes through a center of the one or more explosive notching elements, and wherein the hollow rod is configured to withstand detonation of the one or more explosive notching elements for retrieval from a wellbore.

14. The method of claim 11, wherein emplacing the explosive notching tool in the formation comprises:

conveying the explosive notching tool into the formation by wireline.

15. The method of claim 11, wherein emplacing the explosive notching tool in the formation comprises:

conveying the explosive notching tool into the formation by coiled tubing.

16. The method of claim 11, wherein the one or more circular notches are deep with a narrow width and end in an acute angle.

17. The method of claim 11, wherein the formation is a carbonate or sandstone having low permeability.

18. The method of claim 11, wherein the one or more explosive notching elements comprise a plurality of explosive notching elements and are configured to be fired at least one of sequentially and simultaneously.

19. The method of claim 18, wherein firing the one or more explosive notching elements sequentially comprises:

firing a first explosive notching element of the plurality of explosive notching elements at a lowest depth of a well first.

20. The method of claim 18, wherein:

each of the plurality of explosive notching elements includes a detonator;

the plurality of explosive notching elements is mounted around a hollow mandrel; and electrical wiring is disposed through the hollow mandrel and is coupled to each detonator.

* * * * *